US005169518A

United States Patent [19]

Klimpel et al.

[11] Patent Number: 5,169,518

[45] Date of Patent: Dec. 8, 1992

[54] RECOVERY OF PETROLEUM FROM TAR SANDS

[75] Inventors: Richard R. Klimpel, Midland, Mich.; Basil S. Fee, Sarnia, Canada

[73] Assignee: The Dow Chemical Company, Midland, Mich.

[21] Appl. No.: 756,403

[22] Filed: Sep. 9, 1991

[51] Int. Cl.[5] ..... C10G 1/04

[52] U.S. Cl. ..... 208/390; 208/425

[58] Field of Search ..... 208/390, 425

[56] References Cited

U.S. PATENT DOCUMENTS 3,700,031 10/1972 Germer et al. ..... 166/270
4,029,567 6/1977 Farnand et al. ..... 208/8
4,189,376 6/1983 Mitchell ..... 208/11
4,389,300 6/1983 Mitchell ..... 208/11
4,401,551 8/1983 Mitchell ..... 208/11
4,405,825 9/1983 Fenton et al. ..... 585/13
4,470,899 9/1984 Miller et al. ..... 208/390
4,481,099 11/1984 Mitchell ..... 208/11

*Primary Examiner*—Theodore Morris
*Assistant Examiner*—William C. Diemler

[57] ABSTRACT

The recovery of bitumen from tar sands by flotation is improved by the use of alkanol amines as flotation promoters. Monoethanolamine and diethanolamine are particularly useful for this purpose.

6 Claims, No Drawings

RECOVERY OF PETROLEUM FROM TAR SANDS

BACKGROUND OF THE INVENTION

The present invention is related to the recovery of petroleum from tar sands, also known as oil sands or bituminous sands, by flotation.

Various techniques are recognized as having potential utility for the recovery of bitumen. These include extraction techniques such as flotation with either hot or cold water, water-solvent mixtures and solvent extraction.

In flotation processes, bitumen is extracted from tar sands in a water separation process. Tar sands are mixed with water and are fed, either in a batch or continuous process, to a vessel. The slurry is agitated either with or without air being fed from the bottom of the vessel to the top. The bitumen released from the sands coagulates, rises to the top surface of the vessel and is removed from the vessel for further processing. The undesired sands (primarily silica, clays and similar materials) are rejected and stored in a tailings disposal area.

Process parameters which influence the bitumen recovery include the temperature of the water mixed with the feed ore; the ratio of water to tar sands; the rate of agitation; the rate of air addition; the use of solvents such as hexane, kerosene, percholoroethylene, 1,1,1-trichloroethane and methylene chloride; the use of materials such as ammonia, sodium silicate, potassium hydroxide and sodium hydroxide to aid in releasing bitumen from the host sand and to control pulp viscosity; the use of frothing materials such as alcohols and propylene glycols; the use of surfactants such as those containing carboxylic acid functionalities including natural porphorins; and the time length and sequencing of the various stages of bitumen recovery.

The ratio of water to oil and the temperature of water used are recognized as being highly effective tools to improve the flotation of bitumen. However, modifying these parameters significantly impacts the capital requirements and operating costs of the process. Therefore, other parameters are frequently used to increase productivity of the process. Sodium hydroxide is used extensively to increase the bitumen recovery via flotation. While having positive effects, its use results in dispersion and/or swelling of the clays present in the tar sands which results in greater volumes of waste to store and/or dispose of. Additionally, the presence of sodium hydroxide in the waste pulps causes them to settle (separate solids from the liquid) very slowly so that water recovery and recycle is difficult.

Thus, there remains a need for efficient, cost effective methods to improve the recovery of bitumen from tar sands by flotation.

SUMMARY OF THE INVENTION

The present invention provides a flotation process for the recovery of bitumen having a density of 1.0 gram per cubic centimeter or less from tar sands wherein the tar sands are removed from the ground, mixed with water to form an aqueous slurry having from ten to fifty weight percent solids and subjected to froth flotation in the presence of flotation promoters comprising alkanolamines corresponding to the formula $$R_xNH_{(3-x)}$$

wherein R is independently in each occurrence a $C_{1-6}$ hydroxy alkyl moiety and x is 1, 2 or 3, under conditions such that the bitumen is floated and recovered.

DETAILED DESCRIPTION OF THE ILLUSTRATIVE EMBODIMENTS

Tar sands are sand deposits impregnated with dense, viscous petroleum which also contain small amounts of water. These deposits represent a significant source of hydrocarbon material and are receiving attention in recent years as a commercially viable petroleum source in light of dwindling oil supplies.

Tar sands are reservoir rocks normally containing silica and/or silica like materials whose interstices are partially to totally filled with a viscous to semi-solid hydrocarbon which is called bitumen. The viscosity of the recovered and processed bitumen is generally equal to or greater than the viscosity of No. 5 and No. 6 fuel oils (ASTM standards). This represents a Saybolt viscosity (universal at 38° C.) of about 50 or greater. Bitumen differs from conventional crudes in that its viscosity is so great that it cannot be recovered by primary petroleum recovery methods.

Various tar sands have different characteristics. For example, in some tar sands, the silica substrate is at least partially coated with a layer of water over which is the bitumen coating. In other tar sands, the bitumen directly coats the silica substrate. Different tar sands have varying amounts of bitumen content. Typical amounts of bitumen range from one up to about 25 percent of the tar sands. The feed for most flotation processes contains from about five to about twenty percent bitumen.

The tar sands are removed from the ground and may be first processed to remove large rocks. Water is added to the feed sands to produce a slurry with a water to ore ratio (WOR) of from about 0.10 to about 0.50, more typically from about 0.20 to about 0.40. The temperature at which the slurry is floated ranges from ambient temperatures to pressurized boiling temperatures. Elevated temperatures of from about 50° to about 100° C. at normal boiling pressures are preferred, with from about 60° to about 90° C. being more preferred.

The flotation is carried out in batch or continuous processes and in one or more steps or stages. Chemical additives such as sodium hydroxide which are typically used in tar sands flotation may also be used in the process of this invention. When used, these additives are used as they would be in the absence of this invention, with the exception that dosages required are typically reduced.

The alkanol amines useful in tar sands flotation correspond to the formula $$R_xNH_{(3-x)}$$

wherein R is independently in each occurrence a $C_{1-6}$ hydroxy alkyl moiety and x is 1, 2 or 3. Specific examples of useful alkanol amines include monoethanolamine, diethanolamine, triethanolamine, isopropanolamine, butanolamine and hexanolamine and mixtures thereof. Methods of production of such alkanol amines are well known in the art and such amines are available commercially. It will be recognized that, in some cases, methods of production will result in a mixture containing the desired alkanol amine as well as other amines. Such mixtures are useful in the practice of the present invention.

The amount of alkanol amine useful in the practice of the present invention is any which results in improved recovery of bitumen compared to that obtained in the absence of the alkanolamine. Typically, this amount is from 0.001 weight percent of the ore to 0.5 weight percent of ore. Ore in this context refers to the weight of the bitumen containing tar sands. A more preferred level is from 0.005 weight percent of the ore to 0.05 weight percent of ore.

The following examples are provided to illustrate the invention and should not be considered as limiting it in any way. Unless stated otherwise, all parts and percentages are by weight.

EXAMPLE 1

A series of 200 gram samples of tar sands were prepared. The feed sand was 34.5 percent bitumen, 7.0 percent water and the remainder silica.

A 200 g portion of the feed sand and 800 g water were added to a heated 1000 $cm^3$ vessel. The resulting pulp was stirred by hand paddling with the temperature of the pulp being maintained at approximately 40° C. Air was introduced through a porous frit and delivery tube at the bottom of the vessel. Flotation was carried out for five minutes and then bitumen was collected by hand paddling. The concentrate and tailings were analyzed for carbon to determine bitumen recovery, assuming that only the bitumen contained carbon. The data collected is shown in Table I below.

| | NaOH (g) | Alkanolamine (g) | % Carbon Recovered |
|---|---|---|---|
| 1[1] | — | — | 30.4 |
| 2[1] | 0.5 | — | 38.6 |
| 3[1] | 1.0 | — | 54.70 |
| 4[1] | 2.0 | — | 73.0 |
| 5 | — | Ethanolamine (0.5) | 46.3 |
| 6 | — | Diethanolamine (0.5) | 55.9 |
| 7 | — | Triethanolamine (0.5) | 39.7 |
| 8 | — | Isopropanolamine (0.5) | 42.5 |
| 9 | — | Butanlamine (0.5) | 37.6 |
| 10 | — | Hexanolamine (0.5) | 35.2 |
| 11 | 0.5 | Ethanolamine (0.5) | 79.4 |
| 12 | 0.5 | Diethanolamine (0.5) | 86.5 |
| 13 | 0.5 | Triethanolamine (0.5) | 47.8 |
| 14 | 1.0 | Diethanolamine (0.5) | 93.7 |
| 15 | — | Diethanolamine (1.0) | 63.7 |
| 16 | — | Diethanolamine (2.0) | 88.0 |

[1]Not an embodiment of the invention.

The data in Table I shows that the use of alkanol amines is effective in increasing bitumen (carbon) recovery under laboratory conditions.

EXAMPLE 2

Five hundred gram samples were prepared from drum quantities of bituminous sands received from tar sand processors. After the removal of shale, rocks and hard lumps, the samples were carefully homogenized and were then stored in a refrigerator until needed.

The batch extraction unit consists of a hot water jacketed steel pot, a variable speed agitator and flowrator for controlling air feed into agitator mechanism. An exterior hot water bath and pump system is used to maintain the temperature of the jacketed steel pot at 82° C.

In each run, a 500 gram sample of the tar sands was transferred to the steel pot. Sufficient 90° C. water was added to create a fluid water-sand mixture in the agitation stage. The water to ore ratio (WOR) was 0.22. The resulting pulp was agitated at 600 revolutions per minute (rpm) and aerated at 0.42 liters per minute for 10 minutes. After agitation and aeration were stopped, additional 82° C. water (total water 1 liter) was added to steel pot. The mixture was agitated for 10 minutes. When agitation was stopped, the float product was removed using a specially designed spatula. Bitumen which adhered to spatula and to the lip of float cell was recovered on weighed paper swabs and included in the product container. This material is reported as the primary recovery.

The remaining slurry was agitated at 780 rpm and aerated at 0.234 liters per minute. Aeration and agitation were stopped and a second product (secondary product) was recovered by the technique outlined for primary recovery. Float tails were drained from the cell. Residual bitumen values were washed from the flotation column, from the agitator, and from the float cell with toluene. These values are included in the recovery. Primary float and secondary float products were weighed. Three samples of float feed, primary float products and secondary float products are analyzed in a Dean-Stark extractor for bitumen content, water and solids. Recovery of bitumen in the float product is based on the bitumen content of the individual product relative to the bitumen content of the feed.

In the examples of the present invention, diethanolamine was added to the float cell as the tar sand samples were transferred to the cell. Two different feed ore samples were prepared. On ore number 1 there were 12 tests run (summarized in Table 2) and on ore number 2 there were 10 tests run (summarized in Table 3).

TABLE 2

| Batch Extractions on Ore 1 | | | | | | |
|---|---|---|---|---|---|---|
| Run No. | NaOH (Wt. %) | Diethanolamine (Wt. %) | Water to Oil Ratio | Bitumen in Primary Froth (%) | Water in Primary Froth (%) | Solids in Primary Froth (%) |
| 1① | 0.000 | 0.0000 | 0.22 | 30.98 | 60.45 | 7.15 |
| 2① | 0.018 | 0.0000 | 0.22 | 31.87 | 59.90 | 7.20 |
| 3① | 0.036 | 0.0000 | 0.22 | 39.72 | 44.62 | 8.13 |
| 4 | 0.000 | 0.0125 | 0.22 | 30.37 | 61.21 | 7.62 |
| 5 | 0.000 | 0.0250 | 0.22 | 25.40 | 61.21 | 11.21 |
| 6 | 0.018 | 0.0125 | 0.22 | 36.92 | 54.96 | 6.51 |
| 7 | 0.036 | 0.0125 | 0.22 | 43.02 | 50.07 | 8.09 |
| 8① | 0.000 | 0.0000 | 0.40 | 52.47 | 40.66 | 7.73 |
| 9① | 0.018 | 0.0000 | 0.40 | 56.57 | 32.28 | 7.31 |
| 10 | 0.000 | 0.0125 | 0.40 | 54.95 | 35.42 | 7.39 |
| 11 | 0.000 | 0.0250 | 0.40 | 54.37 | 37.46 | 6.61 |
| 12 | 0.018 | 0.0125 | 0.40 | 55.51 | 36.44 | 6.85 |

Bitumen

TABLE 2-continued

Batch Extractions on Ore 1

| Run No. | in Secondary Froth (%) | Water in Secondary Froth (%) | Solids in Secondary Froth (%) | Primary Recovery (%) | Total Recovery (%) | Bitumen in Total Froth (%) | Solids in Total Froth (%) | Water in Total Froth (%) |
|---|---|---|---|---|---|---|---|---|
| 1① | 20.28 | 65.71 | 10.29 | 20.24 | 54.49 | 22.85 | 9.54 | 64.45 |
| 2① | 20.71 | 36.84 | 11.03 | 26.44 | 60.21 | 24.12 | 9.86 | 43.88 |
| 3① | 30.14 | 55.80 | 15.56 | 55.43 | 89.19 | 35.36 | 11.51 | 49.71 |
| 4 | 20.64 | 66.50 | 10.47 | 23.74 | 58.09 | 23.42 | 9.66 | 64.99 |
| 5 | 18.48 | 67.98 | 14.43 | 52.12 | 70.65 | 23.04 | 12.31 | 63.52 |
| 6 | 21.55 | 66.64 | 10.80 | 36.63 | 71.71 | 27.05 | 9.27 | 62.46 |
| 7 | 28.92 | 56.00 | 14.20 | 61.70 | 90.89 | 37.08 | 10.66 | 52.57 |
| 8① | 17.54 | 68.45 | 13.07 | 60.28 | 81.43 | 34.24 | 10.52 | 55.17 |
| 9① | 15.64 | 69.87 | 12.67 | 70.72 | 84.82 | 39.14 | 9.59 | 46.05 |
| 10 | 17.78 | 59.76 | 13.49 | 67.33 | 84.93 | 37.95 | 10.18 | 46.55 |
| 11 | 16.88 | 70.28 | 11.64 | 67.20 | 83.84 | 37.44 | 8.88 | 48.29 |
| 12 | 15.35 | 58.74 | 12.36 | 67.09 | 81.69 | 37.53 | 9.32 | 46.42 |

①Not at embodiment of the invention.

TABLE 3

Batch Extractions on Ore 2

| Run No. | NaOH (Wt. %) | Diethanolamine (Wt. %) | Water to Oil Ratio | Bitumen in Primary Froth | Water in Primary Froth | Solids in Primary Froth |
|---|---|---|---|---|---|---|
| 1① | 0.000 | 0.0000 | 0.22 | 17.29 | 74.68 | 5.52 |
| 2① | 0.036 | 0.0000 | 0.22 | 27.96 | 65.29 | 5.98 |
| 3① | 0.072 | 0.0000 | 0.22 | 55.43 | 36.30 | 12.58 |
| 4 | 0.000 | 0.0050 | 0.22 | 26.24 | 62.25 | 7.16 |
| 5 | 0.000 | 0.0250 | 0.22 | 23.78 | 67.44 | 7.90 |
| 6 | 0.000 | 0.0500 | 0.22 | 29.16 | 63.17 | 6.75 |
| 7 | 0.036 | 0.0050 | 0.22 | 36.77 | 54.68 | 6.93 |
| 8 | 0.036 | 0.0125 | 0.22 | 37.46 | 51.42 | 6.96 |
| 9 | 0.036 | 0.0250 | 0.22 | 36.56 | 54.21 | 6.94 |
| 10 | 0.072 | 0.0250 | 0.22 | 54.76 | 36.59 | 6.31 |

| Run No. | Secondary Froth (SF) Wt. (g) | SF Bitumen (%) | SF Water (%) | SF Solids (%) | Primary Recovery (%) | Total Recovery (%) | Bitumen in Total Froth (%) | Solids in Total Froth (%) | Water in Total Froth (%) |
|---|---|---|---|---|---|---|---|---|---|
| 1① | 91.30 | 17.17 | 66.78 | 12.29 | 9.96 | 41.75 | 17.19 | 11.18 | 68.08 |
| 2① | 88.88 | 20.82 | 68.08 | 11.10 | 18.91 | 56.47 | 22.44 | 9.94 | 67.45 |
| 3① | 22.11 | 21.84 | 58.73 | 17.90 | 86.47 | 96.27 | 47.82 | 13.78 | 41.38 |
| 4 | 95.70 | 17.78 | 69.55 | 11.04 | 19.22 | 53.76 | 19.74 | 10.14 | 67.86 |
| 5 | 92.02 | 18.56 | 67.49 | 11.79 | 19.23 | 53.88 | 19.95 | 10.76 | 67.48 |
| 6 | 94.10 | 19.22 | 68.71 | 10.74 | 22.29 | 58.96 | 21.73 | 9.73 | 67.31 |
| 7 | 89.32 | 19.70 | 68.54 | 10.48 | 37.82 | 73.49 | 25.52 | 9.27 | 63.82 |
| 8 | 76.02 | 23.96 | 63.63 | 10.93 | 46.90 | 83.85 | 29.77 | 9.22 | 58.37 |
| 9 | 77.95 | 22.27 | 70.88 | 10.50 | 37.79 | 73.00 | 27.62 | 9.17 | 64.64 |
| 10 | 17.34 | 20.74 | 55.63 | 18.43 | 90.29 | 97.59 | 48.69 | 8.47 | 39.99 |

①Not an embodiment of the invention.

The data presented in Table 2 above shows the effect of the present invention as well as the effect of varying other parameters in the recovery of bitumen by flotation. Runs 1 and 8, which are not examples of the present invention demonstrate the effect of increasing the water to oil ratio. Runs 4, 5, 6, 7, 10, 11 and 12 demonstrate the improved recoveries obtained by the practice of the present invention. As is clear from comparing Runs 1–7 with Runs 8–12, the impact of the present invention is greater when the water to oil ratio is lower although it is positive in both situations.

As is clear from an examination of the data presented in Tables 2 and 3, the quality of the ore has an impact of the bitumen recovery and the dosage level necessary to obtain desired recoveries.

What is claimed is:

1. A process for the recovery of bitumen from tar sands by flotation of an aqueous slurry of the tar sands, having a water to oil ratio of from 0.50 to 0.10, the improvement comprising conducting the flotation in the presence of flotation promoters comprising alkanolamines corresponding to the formula $$R_xNH_{(3-x)}$$

wherein R is independently in each occurrence a $C_{1-6}$ hydroxy alkyl moiety and x is 1, 2 or 3 and subsequently recovering a bitumen product.

2. The process of claim 1 wherein the alkanolamine is selected from the group consisting of monoethanolamine, diethanolamine and mixtures thereof.

3. The process of claim 2 wherein the alkanolamine is monoethanolamine.

4. The process of claim 2 wherein the alkanolamine is diethanolamine.

5. The process of claim 1 wherein the alkanolamine is used in an amount of from 0.001 to 0.5 weight percent of the ore.

6. The process of claim 1 wherein the flotation is conducted at temperature of from 50° to 100° C.

* * * * *